United States Patent [19]

LaPorte et al.

[11] 3,973,363

[45] Aug. 10, 1976

[54] INFLATABLE STRUCTURES

[75] Inventors: Robert Josse LaPorte, Nogent-sur-Marne; Pierre Maurice Malachard des Reyssiers, Paris, both of France

[73] Assignee: Pneumatiques, Caoutchouc Manufacture et Plastiques Kleber-Colombes, Colombes, France

[22] Filed: Nov. 30, 1973

[21] Appl. No.: 420,709

Related U.S. Application Data

[63] Continuation-in-part of Ser. No. 249,278, May 1, 1972.

[30] Foreign Application Priority Data

Nov. 3, 1969 France ..... 69.37805

[52] U.S. Cl. ..... 52/2

[51] Int. Cl.[2] ..... E04B 1/345

[58] Field of Search ..... 52/2; 5/348–350; 9/11 A, 13, 2 A

[56] References Cited

UNITED STATES PATENTS

| | | | |
|---|---|---|---|
| 19,593 | 3/1858 | Urouhart | 5/348 R |
| 511,472 | 12/1893 | Sumouski | 52/2 |
| 2,018,548 | 10/1935 | Currey | 5/348 R |
| 2,367,835 | 1/1945 | Kreyer | 5/348 R |
| 2,408,789 | 10/1946 | Luisada | 9/2 A |
| 2,655,369 | 10/1953 | Musilli | 5/348 R |
| 3,249,682 | 5/1966 | Laing | 52/2 |
| 3,300,910 | 1/1967 | Isaas | 52/2 |
| 3,388,509 | 6/1968 | Mora | 52/2 |

FOREIGN PATENTS OR APPLICATIONS

| | | | |
|---|---|---|---|
| 452,784 | 5/1913 | France | 9/13 |
| 955,651 | 1/1960 | France | 52/2 |
| 421,827 | 4/1947 | Italy | 5/349 |

*Primary Examiner*—John E. Murtagh
*Attorney, Agent, or Firm*—Brisebois & Kruger

[57] ABSTRACT

This invention relates to inflatable structures, that is to say, to an assembly of parts of which some at least are inflatable and joined one to another in such a fashion that the assembly assumes a specific rigid form after the inflation of the inflatable parts. In accordance with the invention, the inflatable structure comprises a plurality of inflatable enclosures joined together with pressure contact and these inflatable enclosures are located between two layers of flexible material to which they are fixed, placing the said layers under tension. Various shapes are described for the inflatable enclosures and the points of attachment of these enclosures to the upper and lower flexible layers may be the same where it is required to make a flat structure, or different where it is desired to make a curvilinear structure.

2 Claims, 16 Drawing Figures

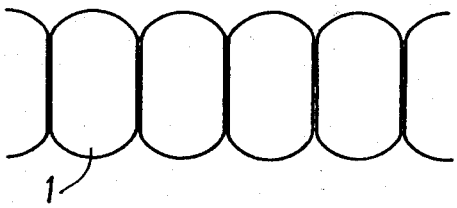
FIG. 1
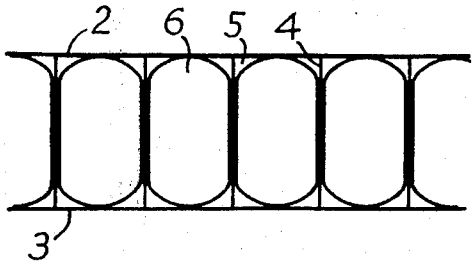
FIG. 2
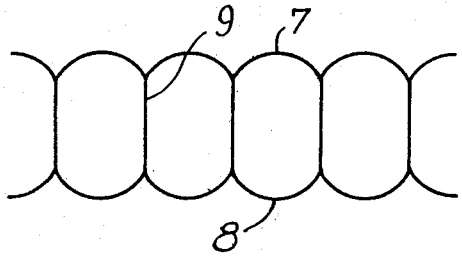
FIG. 3
FIG. 4
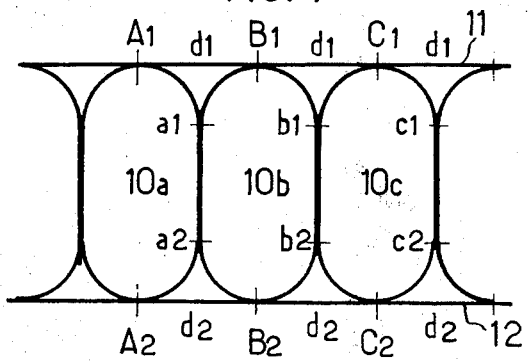
FIG. 5
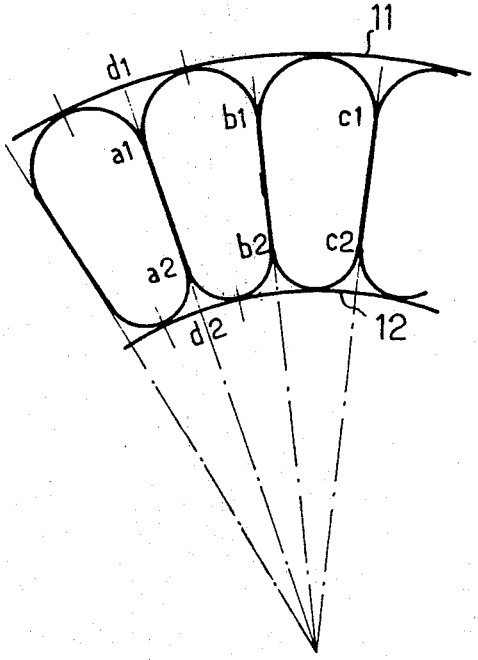

INFLATABLE STRUCTURES

This application is a continuation-in-part from application Ser. No. 249,278 filed May 1, 1972.

The present invention relates to inflatable structures. By inflatable structures is meant an assembly of parts, of which at least some are inflatable, joined one to another in such a fashion that the assembly assumes a specific rigid form after inflation of the inflatable parts.

Inflatable structures in the sense of the foregoing definition have been known for a long time. Thus, U.S. Pat. No. 511,472 dating from 1893 describes such structures; since then many improved inflatable structures have been proposed and described, but, in fact, none has enjoyed the success anticipated. This is attributable to the fact that, up to now, all have suffered from the same major drawback of lack of rigidity.

FIGS. 1, 2 and 3 show in schematic sectional representation the inflatable structures known at the moment.

One kind of known inflatable structure was made up of an assembly of inflatable cells coupled together.

Another type of structure was formed of two layers of woven material linked together by partition walls, also of woven material, which thus defined chambers into which were inserted inflatable bladders which were not fixed to the said layers of woven material and whose purpose was simply to maintain these latter in spaced relationship.

Another form of prior art structure was made up of two layers of a flexible, gas-tight, woven material or sheet, linked together by partition walls also of a gas-tight material so as to define chambers which were subsequently inflated.

In all the above described prior art structures, the same principle was employed, namely to use the pressure of the inflating medium simply to hold two walls apart.

All these structures lack rigidity; in order that they may retain their shape, braces or rigid attachment members had to be used, or certain portions had to be inflated with a lighter-than-air gas such as helium. In this connection, U.S. Pat. No. 511,472 shows structures in which the means used do not allow the desired rigidity to be achieved. It can thus be said that, since 1893 at least, efforts have been made to produce inflatable structures which should be extremely rigid after inflation, but, up to now, no simple expedient has been found which enables this rigidity to be conferred on them.

One object of the invention is an inflatable structure whose rigidity, after inflation of the inflatable parts, may be of any desired magnitude.

Another object of the invention is an inflatable structure which does not exert on its supports any strains other than those due to its weight. A further object of the invention is an inflatable structure which may be made in a large variety of sizes.

Yet another object of the invention is an inflatable structure which may be used to form shelters or parts of shelters, which may or may not be collapsible, or to form objects intended to carry loads, such as bridges and, in a general way, inflatable constructions and articles of many different kinds.

Inflatable structures according to the invention comprise two rectilinear flexible sheets, separated one from the other, and inflatable enclosures situated in the space separating the two sheets, the said inflatable enclosures being fixed to each sheet and being joined together so that, on inflation, they mutually support one another and apply tension to the members forming the two sheets.

The inflatable enclosures are enclosures formed from a flexible sheet or woven material, impervious to the inflating medium. As will be seen below, enclosures can be used which are cellular in nature and may be rectilinear or curvilinear: their section may be constant or vary along their length. Enclosures may also be used which are spheres or cylinders with spherical dome-like ends.

The rectilinear members forming the sheets between which the enclosures are positioned and to which they are fixed must have sufficient mechanical strength to bear the strain imposed by the inflation of the enclosures. This may be incorporated by a layer or strip of woven material or by wires or cords.

The attachment of the rectilinear members forming the two sheets to the enclosures may be effected by conventional means not per se forming part of the invention, for example by bonding.

In order that the invention may be more clearly understood, reference will now be made to the accompanying drawings which, firstly, show some examples of prior art structures and then certain embodiments of the invention by way of example, and in which:

FIGS. 1, 2 and 3 show schematically sections through various prior art inflatable structures, FIG. 4 shows schematically a cross-section through a part of a first embodiment of inflatable structure according to the invention, FIG. 5 shows schematically a cross-section through part of another embodiment of structure;

FIG. 6 shows schematically a cross-section through a third embodiment of structure, FIG. 7 shows a cross-section of the structure of FIG. 6 during erection, FIG. 8 shows schematically a cross-section of another structure according to the invention, used as the collapsible part of a shelter, FIG. 9 shows a section of the structure of FIG. 8 in a partly open state, FIG. 10 shows a perspective view of a structure of the invention, FIG. 11 shows a perspective view of another embodiment of structure according to the invention, FIG. 12 shows a view from above of another embodiment, FIG. 13 shows a cross-section of the structure of FIG. 12 along the line XIII—XIII thereof, FIG. 14 shows a view from above of another embodiment, FIG. 15 shows a view from above of another embodiment, and FIG. 16 shows a view from above of a part of a further embodiment of the invention.

Referring now to the drawings, FIG. 1 shows a first example of an inflatable structure of the prior art, which comprises a plurality of inflatable cells 1 that are coupled together.

FIG. 2 shows another example of a prior art construction which is formed of two layers 2 and 3 of a woven material which are linked together by partition walls 4 which also are of woven material, and these walls thus define chambers 5 serving as location means for inflatable bladders 6 inserted therein. These bladders 6 are not fixed to the layers 2 and 3 and their purpose is simply to maintain the layers 2 and 3 in spaced relationship.

FIGS. 4 and 5 show a flat, inflatable structure; it may, for example, be used as a cover by being placed on the exterior walls of a building.

This structure is made up as shown of rectilinear, inflatable cells, 10*a*, 10*b*, 10*c* . . . which are attached to the sheet 11 at $A_1$, $B_1$, $C_1$ and to sheet 12 at $A_2$, $B_2$, $C_2$.

In this embodiment, the inflatable cells are made of a gas-tight rubberised material and sheets 11 and 12 are of a woven material of which the warp runs perpendicularly to the axis of the cells. Instead of being made up of a woven material, the sheets 11 and 12 could also be formed by cables, mutually parallel and perpendicular to the axis of the cells; in this case, a light and waterproof sheet, made, for example, of a plastics material, could be attached to the upper sheet 11 for waterproofing purposes.

Sheets 11 and 12 are attached to the cells 10 by bonding but they could also be attached by some other conventional means, not forming part of the invention. Since the structure is flat, the lengths $d'$ at A' B', B' C', C' . . . and the lengths $d_2$ at $A_2$ $B_2$, $B_2$ $C_2$, $C_2$ . . . are all of equal size.

The circumference of the cell walls is sufficiently great, taking into account the size of lengths $d_1$ or $d_2$ that, after inflation, cells 10 bear on and support one another. (This condition is fulfilled as soon as the circumference of the boundary walls exceeds the value $\mu$ x $d_1$). The cells are inflated to the same or to a very similar pressure so that their meeting faces, which are formed by lines $a_1$ $a_2$, $b_1$ $b_2$, $c_1$ $c_2$, of FIG. 4 are plane.

When they are deflated, cells 10 are collapsed and the sheets 11 and 12, no longer being under tension, are in close proximity. When the cells are inflated, sheets 11 and 12 move apart and each cell 10, taking a purchase on the adjoining cell, places the portion of the sheet situated between the attachment of the cell to the sheet and the attachment of the adjoining cell to the sheet, under tension.

Thus, successive portions $A_1$ $B_1$, $B_1$ $C_1$, $C_1$ . . . $A_2$ $B_2$, $B_2$ $C_2$, $C_2$ . . . of the two sheets 11, 12, mutually separated by cells 10, are all placed under tension.

The inflatable structures according to the invention, by reason of having two sheets under tension, separated from each other, are extremely rigid and little subject to deformation as a result of external stresses such as those due to gravity or the action of the wind. This rigidity increases as sheets 11 and 12 are more strongly tensioned. The tension of the sheets varies both as a function of the pressure inside the cells and of the length of the portions $a_1$ $a_2$, $b_1$ $b_2$, $c_1$ $c_2$ . . . it may thus be set to the desired amount by varying the pressure inside the cells by giving to the cells a circumference such that the length of said portions is greater or smaller.

The tension of each section of sheet, such as $A_1$ $B_1$ or $A_2$ $B_2$ being in each transverse section exactly balanced, cells 10 can be as long as desired which means that the range of sizes of the inflatable structures in the invention is theoretically unlimited.

Not only are the inflatable structures self-stabilising (i.e. they do not distort of themselves in the absence of external stresses), once inflation is completed, but also, during inflation, the parts already inflated are themselves self-stabilising (and similarly during deflation). This has the result that, to erect or collapse the structures, it is not necessary to use additional means to support or guide them and that, with advantage, they may be used to produce constructions which are wholly or partly collapsible. This self-stabilising property has the additional result that any bases or foundations used, which have only to bear the strains due to the weight of the structures, which are extremely light, are of minor importance.

The structure shown in FIG. 6 is formed similarly to those in FIGS. 4 and 5 but lengths $d_1$ and $d_2$, instead of being equal, are different, which gives the structure a curvilinear shape. The lines $a_1$ $a_2$, $b_1$ $b_2$, $c_1$ $c_2$, shown in FIGS. 4 and 5 are decreased to zero in the arrangement of FIG. 6 meeting at a point which is the centre of the circle of curvature of which the radius depends both on the ratio $d_1/d_2$ and on the distance separating the two sheets 11 and 12 which itself depends on the circumference of the inflatable cells.

FIG. 6 shows in fact a cross-section through a shelter such as a shed, having the shape of a segment of a cylinder.

This shelter is formed by an inflatable structure similar to that in FIG. 5; cells 10 place the portions of the sheets 11 and 12 extending between two adjoining cells under tension; lengths $d_1$ and $d_2$ are unequal.

This construction may be of very large dimensions and, on account of its small weight and of the absence of stresses not vertical to the ground, it may be erected on surfaces of loose consistency without the need for considerable foundation work.

FIG. 7 shows the ease of erection of such a construction, which is, and remains, self-stabilising during inflation of the cells. The central cells are inflated first; due to this inflation, the central portion of the structure takes up the curve described by a radius R equal to that in the construction in FIG. 6 and the central portion, inflated, being self-stabilising, there is no need to use additional means of support or guidance; the process is continued by inflating the cells immediately adjacent to the portion already inflated and so on; when the two end cells are inflated, the whole of the structure has been formed and is ready for use. From this example, it can be seen that the erection of structures according to the invention is extremely simple. Similarly, to collapse such a structure, it is merely necessary to deflate the end cell then the immediately adjacent cells and so on.

The inflatable structure in FIGS. 8 and 9 constitute the collapsible portion of a shelter.

Cells 10 form an arc and their cross-section decreases from the centre towards the ends; in addition, the distances $d_1$ and $d_2$ between the attachments of two adjacent cells to the sheets 11 and 12 are unequal as in the case of FIG. 6; thus, a dome-shaped structure is obtained.

In the embodiment, this inflatable dome rests on another part 13 of the shelter; this part 13 is built of masonry and includes a projecting portion 13*a* against the face 13*b* of which the inflatable dome bears.

The inflatable dome may be totally or partially collapsed by deflating the lower cells as at 10*a* in FIG. 9 which Figure shows the shelter of FIG. 8 with the dome partially collapsed.

When the lower cells 10*a* are deflated, the corresponding portions of the dome weaken and fold up and the upper cell 10*b* moves away from part 13*a*; each cell, still inflated, moves around an axis passing through the centre 0 of the circle of curvature each time one of the lower cells is deflated, which brings about the opening of the dome. As has been explained above, the portion of the dome still inflated is self-stabilising which allows the dome to be left partially open, if desired.

In the structure in FIG. 10, which is a segment of cylinder, the cells are straight-sided and arranged parallel to the axis of the cylinder, i.e., parallel to the faces on which it rests. Here the curvature results from the fact that the distances between the attachments of two adjacent cells to the upper and lower sheet (i.e. portions $d_1$ and $d_2$ of FIG. 4) are unequal.

The structure in FIG. 11 has the same shape as that of FIG. 10 but the arch-shaped cells are perpendicular to the axis of the cylinder. Here the equivalent to distances $d_1$ and $d_2$ are equal, the curvature of the structure resulting from the shape of the cells.

In the inflatable structures described up to this point, the enclosures are formed by laterally flattened tubular cells, i.e. cylindrical formations. However, as referred to above, the enclosures may also be spheres or cylinders whose ends terminate in spherical domes; inflatable enclosures of this latter kind will hereinafter be called "spherical enclosures or "inflatable spherical enclosures".

The application of the invention to the use of inflatable spherical enclosures, will be explained by FIGS. 12, 13 in the case of inflatable structures assumed to comprise only seven inflatable enclosures.

In the case of FIGS. 12 and 13 the inflatable enclosures are spheres linked together. Two adjacent spheres are attached to two straight and flexible members 14 and 16, situated diametrically oppositely of the spheres, tangential to one another and parallel to the plane of the centres of the spheres. There are thus twelve flexible members 14 and twelve flexible members 16, each of these members being attached to two adjacent spheres; the attachment points of the flexible members 14 and 16 to the spheres carry respectively references $A'_1, B'_1, C'_1 \ldots A'_2, B'_2, C'_2 \ldots$ if the structure is to be flat, the lengths $A'_1 B'_1, B'_1 C'_1, C'_1 A'_1 \ldots$ are equal to lengths $A'_2 B'_2, B'_2 C'_2, C'_2 A'_2 \ldots$ and, so that, after inflation, the spheres may press against one another, the flexible members 14 and 16 are of a length at least slightly smaller than the radius of the spheres.

As above where the inflatable enclosures were laterally flattened tubes, after inflation, the spheres press against one another and tense members 14 and 16.

If the structure is to take up a curve, lengths such as $A'_1 B'_1$ and $A'_2 B'_2$ are unequal, the shorter ones being placed, with regard to the spheres, on the same side as the centre of curvature, as in the case where the inflatable enclosures are laterally flattened tubes.

After inflation of the spheres, the members 14 and 16 form two layers, each of which is a trellis or a mesh configuration, the members of which are under tension.

Members 14 and 16 may be formed by an assembly of parallel wires or cords; they may also be made up by strips either of woven material or of a material having sufficient mechanical strength.

In most cases, it is necessary to render the structures impervious, for example to rain; it is then sufficient to attach to members 14 or 16 a continuous, impervious sheet.

Finally, instead of attaching members in the form of strips to the spheres, a sheet or a woven material having no discontinuities, may be attached thereto, provided that it possesses sufficient mechanical strength in the direction in which it will be under tension due to the effect of the inflation of the spheres.

Instead of spheres, inflated enclosures in the form of a cylinder, the ends of which are formed by spherical domes, may be used; these enclosures, which behave in all respects as spheres, are easier to construct than spheres when the distance separating members 14 and 16 is relatively large, for example more than 50 cm.

Figure 15:
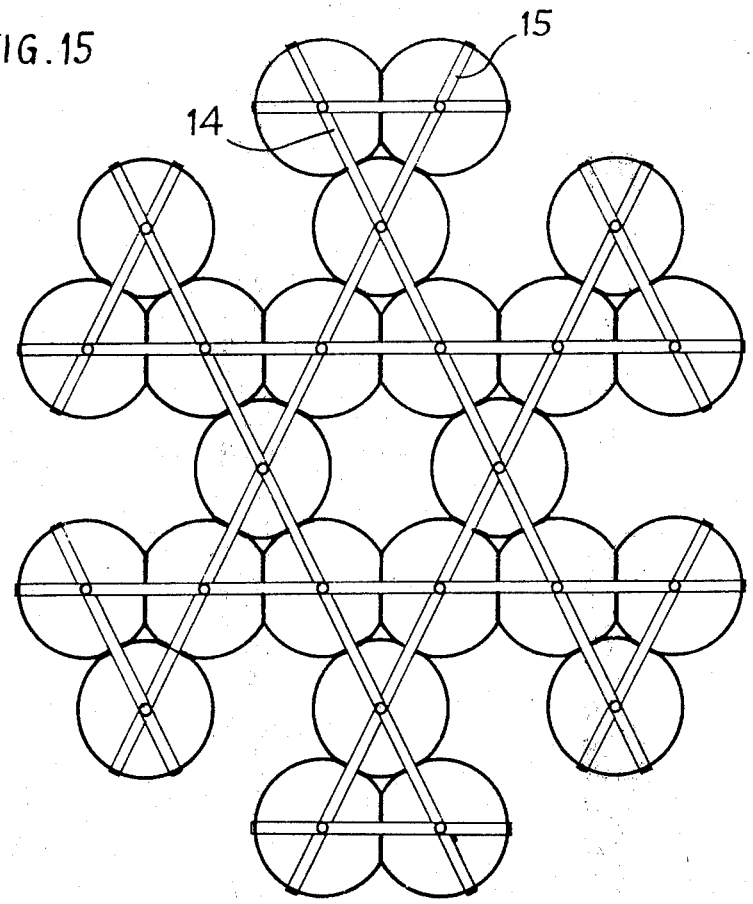
Figure 16:
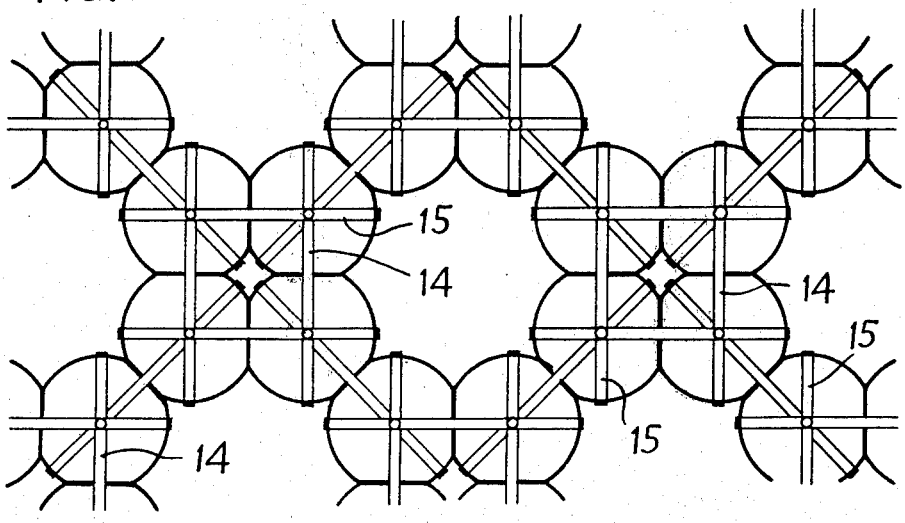

They may also be laid out in the manner shown in FIGS. 15, 16 or in any other way provided that the members 14 and 16 form a mesh pattern, which meshes need not be identical to one another.

FIGS. 12 to 16 show the possible variations of trellis pattern which can be produced; to form structures extending over a greater area, it is merely necessary to join up several patterns, identical or different, by laying out the spheres in the appropriate positions.

Figure 6:
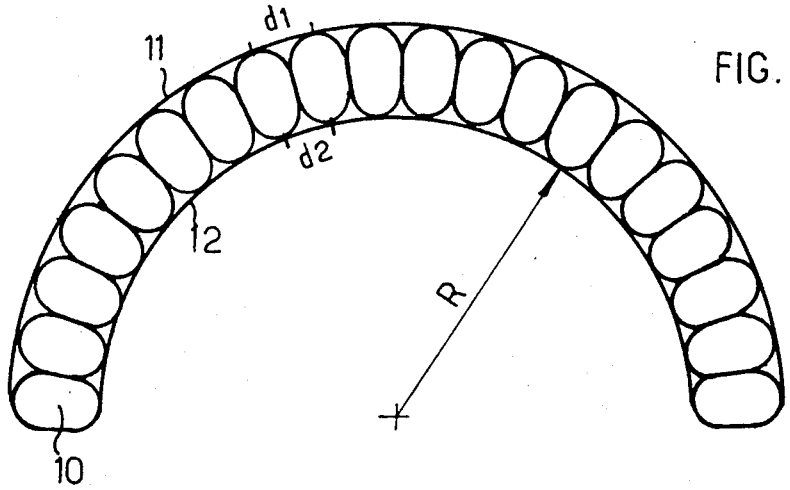
Figure 7:
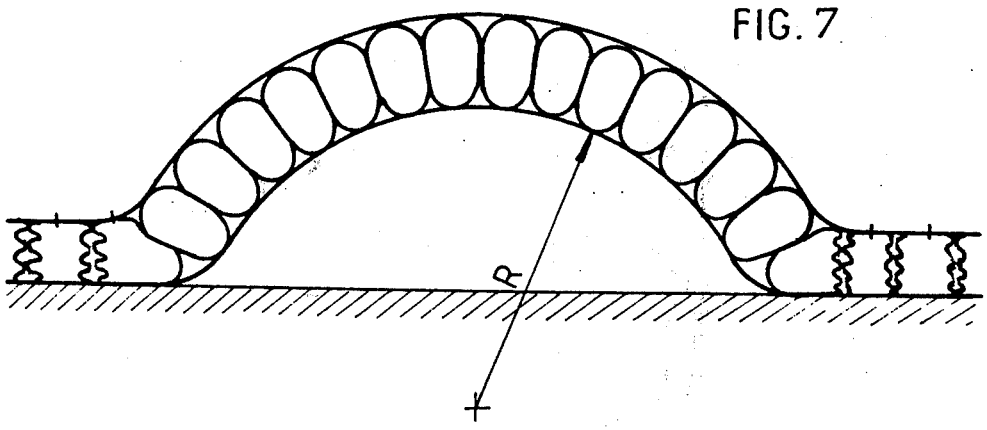
Figure 8:
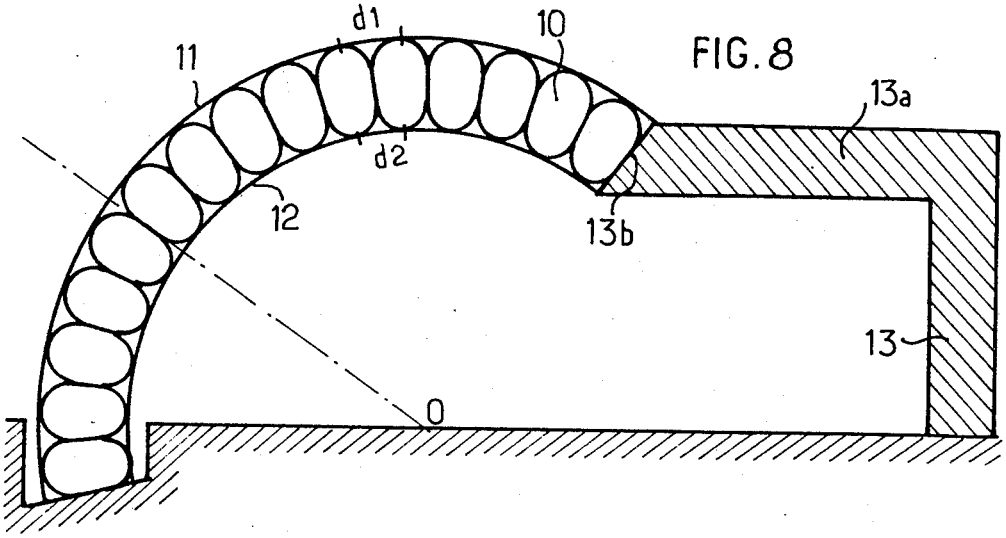
Figure 9:
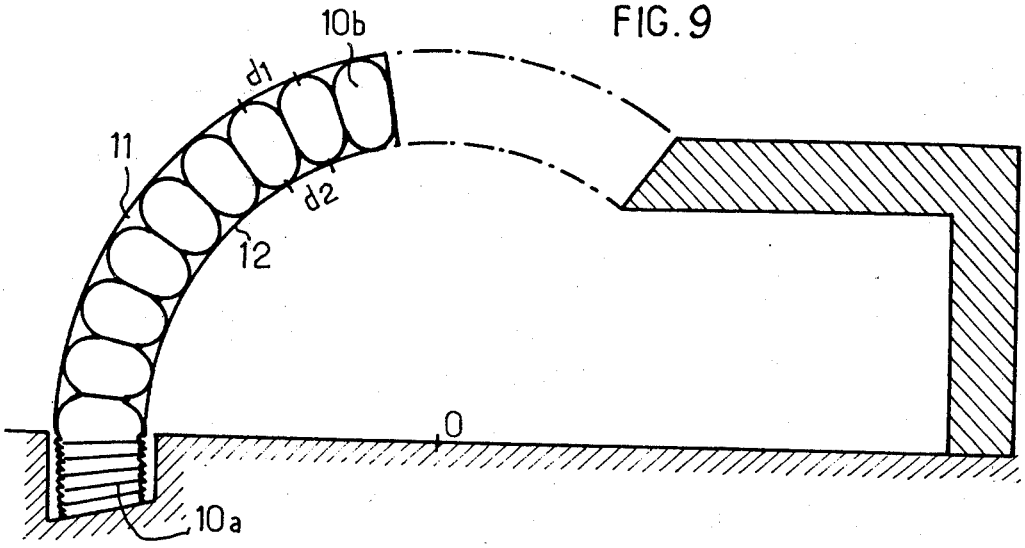
Figure 10:
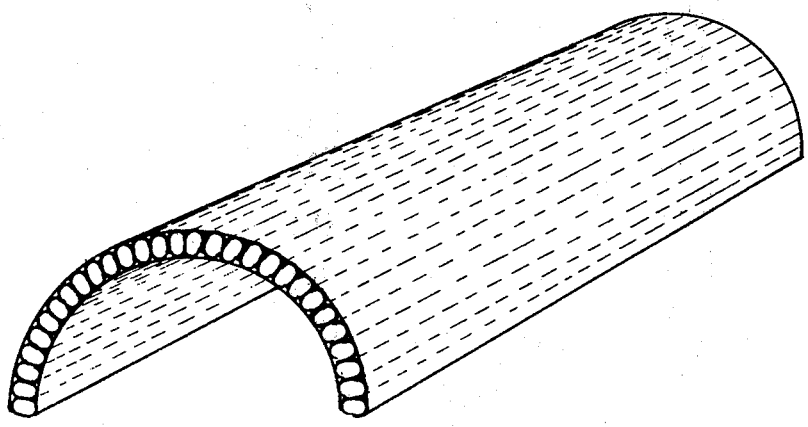
Figure 11:
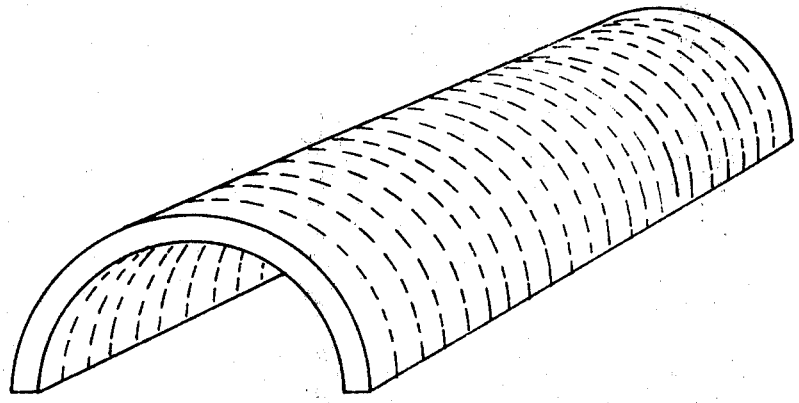
Figure 12:
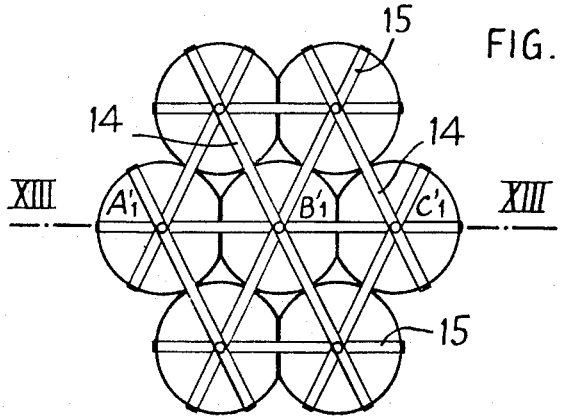
FIG. 12 shows the mesh of a trellis, the members of which meet at an angle of 60°.
Figure 13:
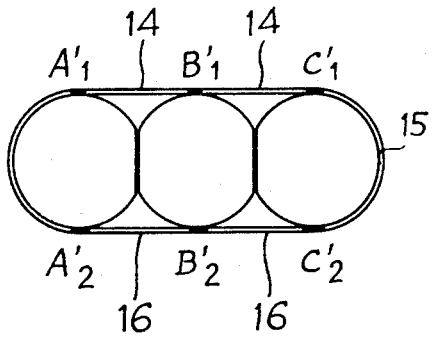
Figure 14:
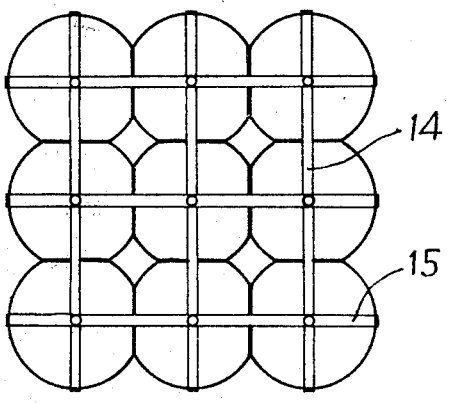
FIG. 14 shows another possible method of laying out the spheres; in this case sphere centres are placed at the corners of squares, which brings about the formation of a trellis, the members of which meet at an angle 90°.

If a member 14 (or 16) is not in alignment with two other adjacent members 14 (or 16), due to the trellis pattern selected, or because the spheres are those on the edge of the structure, the tensions in members 14 (or 16) are not balanced by any other tension. To avoid this, which may be a drawback, it is possible, as shown in FIG. 13, to link members 14 and 16, lying one above the other, by a member 15 lying in the plane of members 14 and 16 and surrounding the hemisphere which, in relation to members 14 and 16, points outwards; this member 15 may be identical to members 14 or 16.

By using spherical enclosures, inflatable structures according to the invention may be produced having the shape of a dome or exhibiting multiple and various curvatures, more easily than by using laterally flattened tubes; in fact, it is sufficient to vary the length of members 14 and 16 if spherical enclosures are being used, while arch-shaped cells must be made if it is desired to produce structures, which like the domes, are not in the form of a segment of a cylinder or a succession of segments of cylinder.

We claim:

1. An inflatable structure comprising a plurality of inflatable enclosures, each of said enclosures having a wall which is part-spherical in shape, and two layers of flexible material fixed to said enclosures at points on opposite sides of said spheres, each of said layers comprising a plurality of discrete elongated members of flexible material held permanently under tension when said enclosures are inflated, the distance between the points at which one of said layers is fixed to said enclosures being greater than the distance between the points at which the other of said layers is fixed to said enclosures, so that inflation of said enclosures results in a curved structure.

2. An inflatable structure as claimed in claim 1 in which said inflatable structures are spheres.

* * * * *